US007486908B2

(12) United States Patent
Ikebata

(10) Patent No.: US 7,486,908 B2
(45) **Date of Patent: *Feb. 3, 2009**

(54) IMAGE FORMING APPARATUS WITH INDICATING SECTION FOR INDICATING INITIAL POSITIONS OF INSERTION PATHS

(75) Inventor: Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/649,196

(22) Filed: Jan. 3, 2007

(65) Prior Publication Data

US 2007/0110472 A1 May 17, 2007

Related U.S. Application Data

(62) Division of application No. 11/402,104, filed on Apr. 11, 2006, now Pat. No. 7,174,116.

(30) Foreign Application Priority Data

Apr. 19, 2005 (JP) ..... 2005-121176

(51) Int. Cl.
*G03G 15/00* (2006.01)

(52) U.S. Cl. ..... 399/110

(58) Field of Classification Search ..... 399/110, 399/111, 116, 117, 119
See application file for complete search history.

(56) References Cited

U.S. PATENT DOCUMENTS

| | | | | |
|---|---|---|---|---|
| 5,485,244 | A * | 1/1996 | Gotoda et al. | 399/111 |
| 7,174,116 | B2 * | 2/2007 | Ikebata | 399/110 |
| 2005/0047825 | A1 * | 3/2005 | Nakano et al. | 399/119 |
| 2005/0074259 | A1 * | 4/2005 | Tachiki et al. | 399/121 |

FOREIGN PATENT DOCUMENTS

| | | |
|---|---|---|
| JP | 4-356062 | 12/1992 |

* cited by examiner

*Primary Examiner*—David M Gray
*Assistant Examiner*—Geoffrey T Evans
(74) *Attorney, Agent, or Firm*—Gerald E. Hespos; Anthony J. Casella

(57) ABSTRACT

A chamber (2A) adapted to dismountably mount respective units (10) and (10) is formed in a main body (2). Guiding members (37, 38, 39) are formed on each of the opposite side walls of the chamber, and guided portions (11A, 11B, 24A, 24B) formed on opposite sides of the respective units (10, 20) are engaged with the guiding members so that they are guided to the mounting position. Near the initial portions (37A, 38A, 39A) of the respective guiding members (37, 38, 39) in the main body (2), an indicating member (41) including indicators (41*a*, 41*b*, 41*c*) which indicates initial positions of the respective guiding member (37, 38, 39). Consequently, the initial positions of the guided members (11A, 11B, 24A) and (24B) of the respective units (10, 20) can be visually confirmed by the indicators (41*a*, 41*b*, 41*c*), which improves the operability of insertion of the respective units (10, 20).

18 Claims, 10 Drawing Sheets

IMAGE FORMING APPARATUS WITH INDICATING SECTION FOR INDICATING INITIAL POSITIONS OF INSERTION PATHS

This application is a divisional of U.S. patent application Ser. No. 11/402,104, filed Apr. 11, 2006.

BACKGROUND OF THE INVENTION

1. Field of the Invention

The present invention relates to an image forming apparatus, such as a copying machine, a printer, a facsimile machine, and a composite machine having functions of copying, facsimile, and the like.

2. Description of the Related Art

Conventionally, as described in Japanese Unexamined Patent Publication No. HEI 04-356062, there exists an image forming apparatus comprising a drum unit including a photoconductive drum and a developing unit including a developing sleeve, the respective units being constructed as separate bodies and dismountably mounted to a main body.

Such image forming apparatus as described above comprises a chamber for dismountably mounting the respective units to a main body of the apparatus. On each of the opposite inner side walls of the chamber, guiding members to which guided members formed on the opposite exterior side portions of the respective units are engaged are formed so that the respective units are guidedly inserted to a predetermined mounting position in the main body.

However, such conventional image forming apparatus has a problem that operability for insertion of the respective units is not so good since it is difficult to distinguish an initial position of an insertion path of each guiding member in the case where the guided portion of each unit is engaged with the respective guiding portion in the chamber for replacement and such. Especially, improvement in operability for insertion of the developing unit is requested since the developing unit is frequently mounted or dismounted with respect to the image forming apparatus for fixing up jamming of paper sheets.

Further, it is requested to prevent the drum unit and the developing unit from being inserted in wrong order.

SUMMARY OF THE INVENTION

The present invention has worked out in view of the problems described above, and its object is to provide an image forming apparatus having a construction to improve operability for insertion of two or more units having different functions and to prevent them from being inserted in wrong order.

According to an aspect of the invention, an image forming apparatus comprises: a main body having a chamber; a plurality of units having operative functions different from one another, respectively, each unit having a guided portion, and being dismountably mounted in the chamber of the main body; a plurality of pairs of guiding members defining respective insertion paths for the plurality of units, each pair of guiding members being formed on the opposite walls of the chamber; and a plurality of indicators provided in the main body for indicating initial positions of the insertion paths, respectively.

With this construction, since initial positions of insertion paths for the plurality of units are indicated by the corresponding indicators, the initial positions of insertion paths for the respective units can be visually confirmed by the user.

Therefore, the guided portions of the respective units can be smoothly set in the respective insertion paths defined by the guiding members. The operability of insertion of the respective units can be improved.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Figure 1:
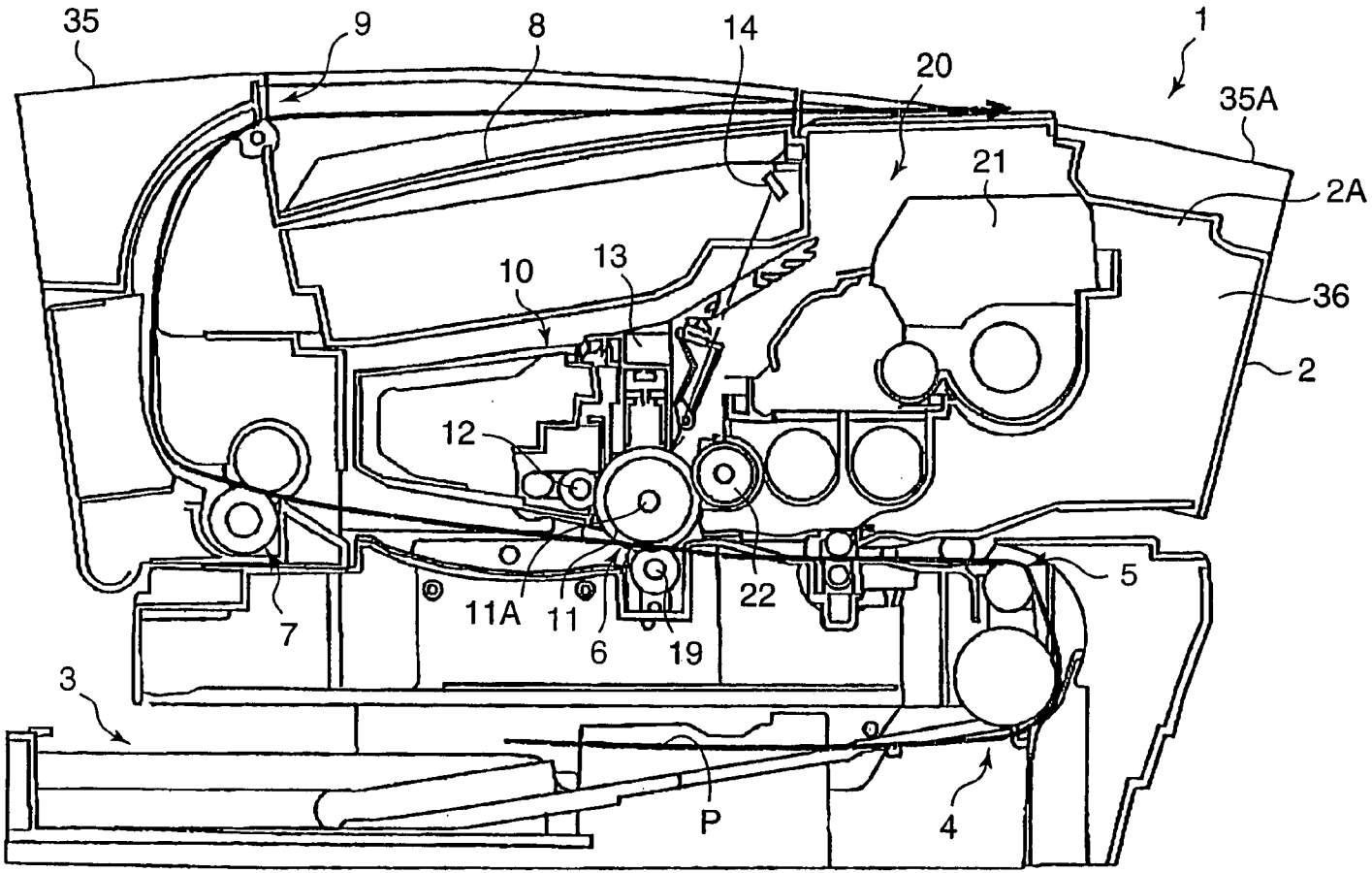
FIG. 1 is a schematic cross-sectional diagram showing a construction of an image forming apparatus according to an embodiment of the invention.

FIG. 1 is a schematic cross-sectional diagram of an image forming apparatus 1. The image forming apparatus 1 comprises in a rectangular box-shaped main body 2, a paper feeding portion 4, a paper conveyance portion 5, an image forming portion 6, a fixing device 7, and a discharging portion 9. The paper feeding portion 4 is adapted to send out a recording medium P from a paper feeding tray 3. The paper conveyance portion 5 is adapted to convey the recording medium P which is conveyed from the paper feeding portion 4. The image forming portion 6 is adapted to transfer a toner image onto the recording medium P conveyed by the paper conveyance portion 5. The fixing device 7 is adapted to fix a toner image which has been transferred onto the recording medium P by the image forming portion 6. The discharging portion 9 is adapted to discharge the recording medium P on which a toner image has been fixed by the fixing device 7 to an external paper discharging tray 8. The recording medium P may be paper, plastic film, OHP sheet and such.

The image forming portion 6 includes a drum unit 10 having a photoconductive drum 11, a developing unit 20 having a developing sleeve, and a transferring roller 19. The transferring roller 19 is adapted to transfer a toner image formed on a surface of the photoconductive drum 11 to the recording medium P. The drum unit 10 and the developing unit 20 are separately constructed and are dismountably mounted in the main body 2 respectively for replacement and such.

Figure 2:
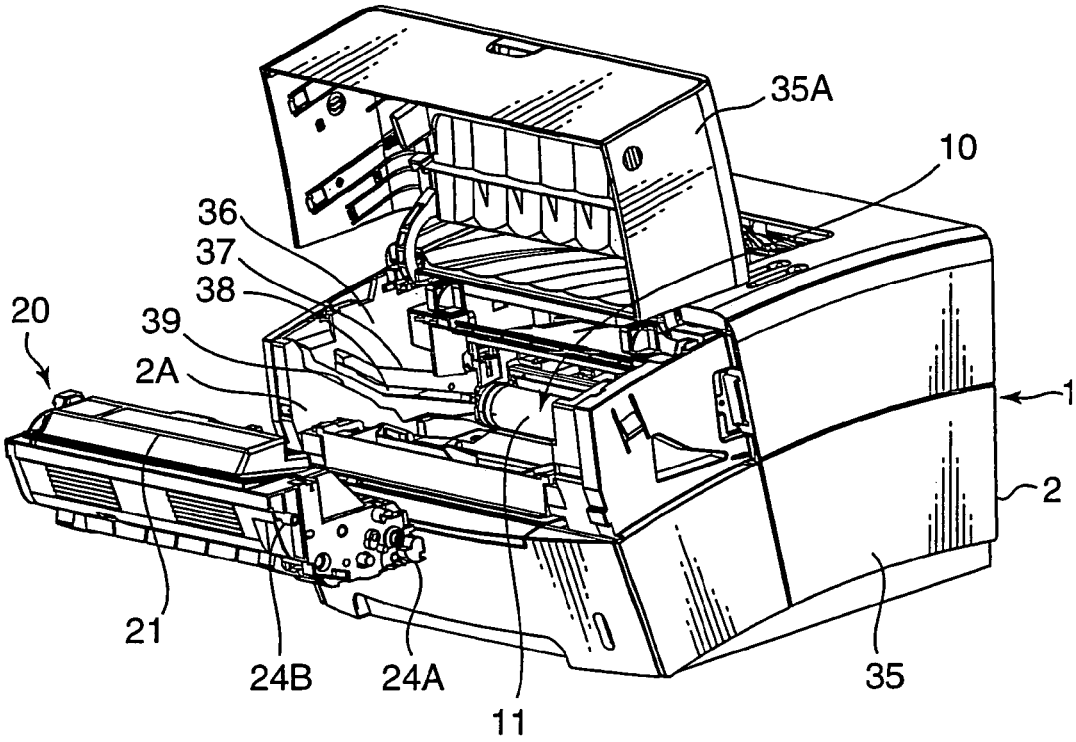
FIG. 2 is a perspective view showing a state where a chamber cover is opened.

As shown in FIG. 2, the main body 2 is provided with an exterior cover 35 and comprises a chamber 2A for permitting the respective drum and developing units 10, 20 to be dismountably mounted in the main body 2. A chamber cover 35A is mounted at the anterior portion of the main body 2 and is rotatable in upward and downward directions so that the chamber 2A can be opened and closed.

Referring back to FIG. 1, in a state where the drum unit 10 is connected with the developing unit 20, the photoconductive drum 11 is located at the lower portion of the drum unit 10 facing the developing unit 20. The photoconductive drum 11 is axially supported at the drum unit 10 rotatably about a drum shaft 11A.

A cleaner 12, a charging device 13 and a discharging device (unillustrated) are provided around the photoconductive drum 11. The cleaner 12 is adapted to remove toner particles remained on the surface of the photoconductive drum 11. The charging device 13 is adapted to evenly charge the surface of the photoconductive drum 11. The discharging device is adapted to remove residual electric charge. A light directing device 14 irradiates a laser light ray to the photoconductive drum 11.

Figure 3:
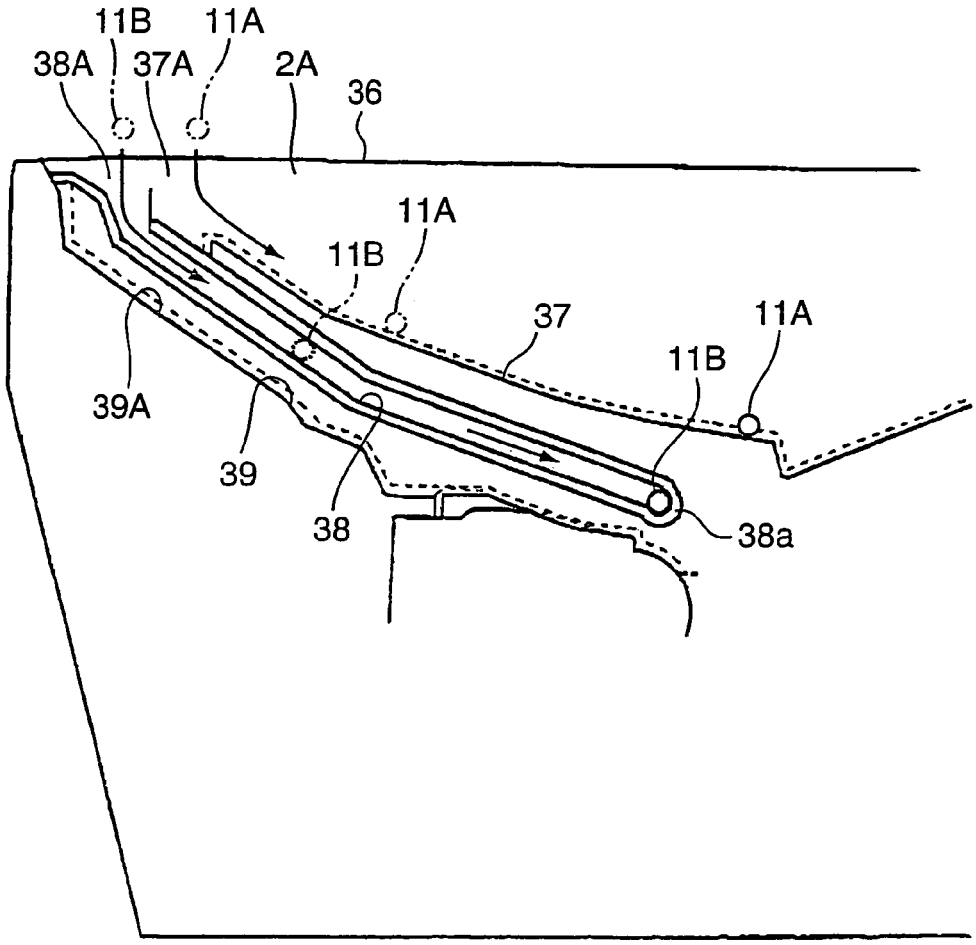
FIG. 3 is a diagram showing a relevant part of a guiding way formed on a main frame.
Figure 4:
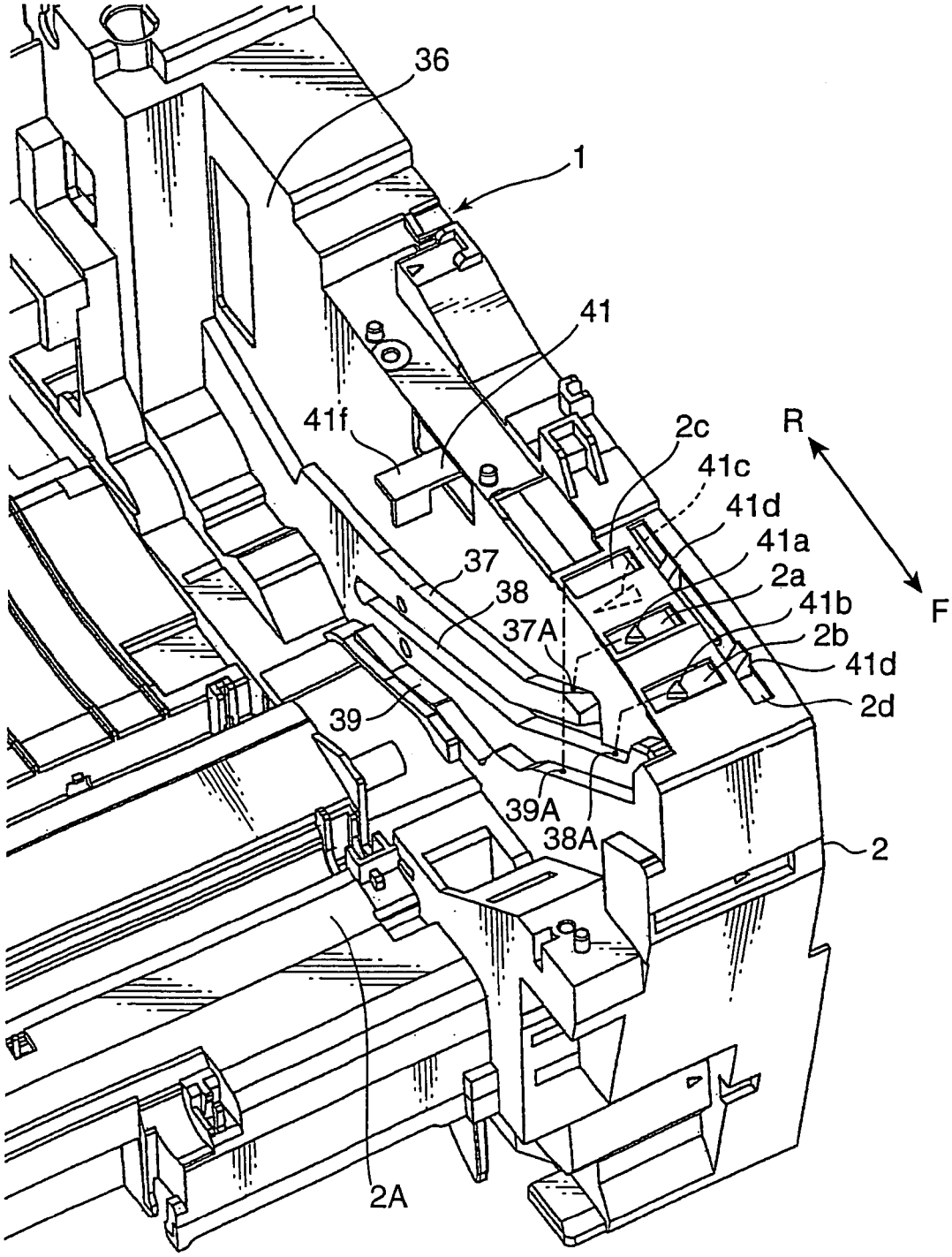
FIG. 4 is a perspective view showing a relevant part of a main body in a state before units are mounted.
Figure 5:
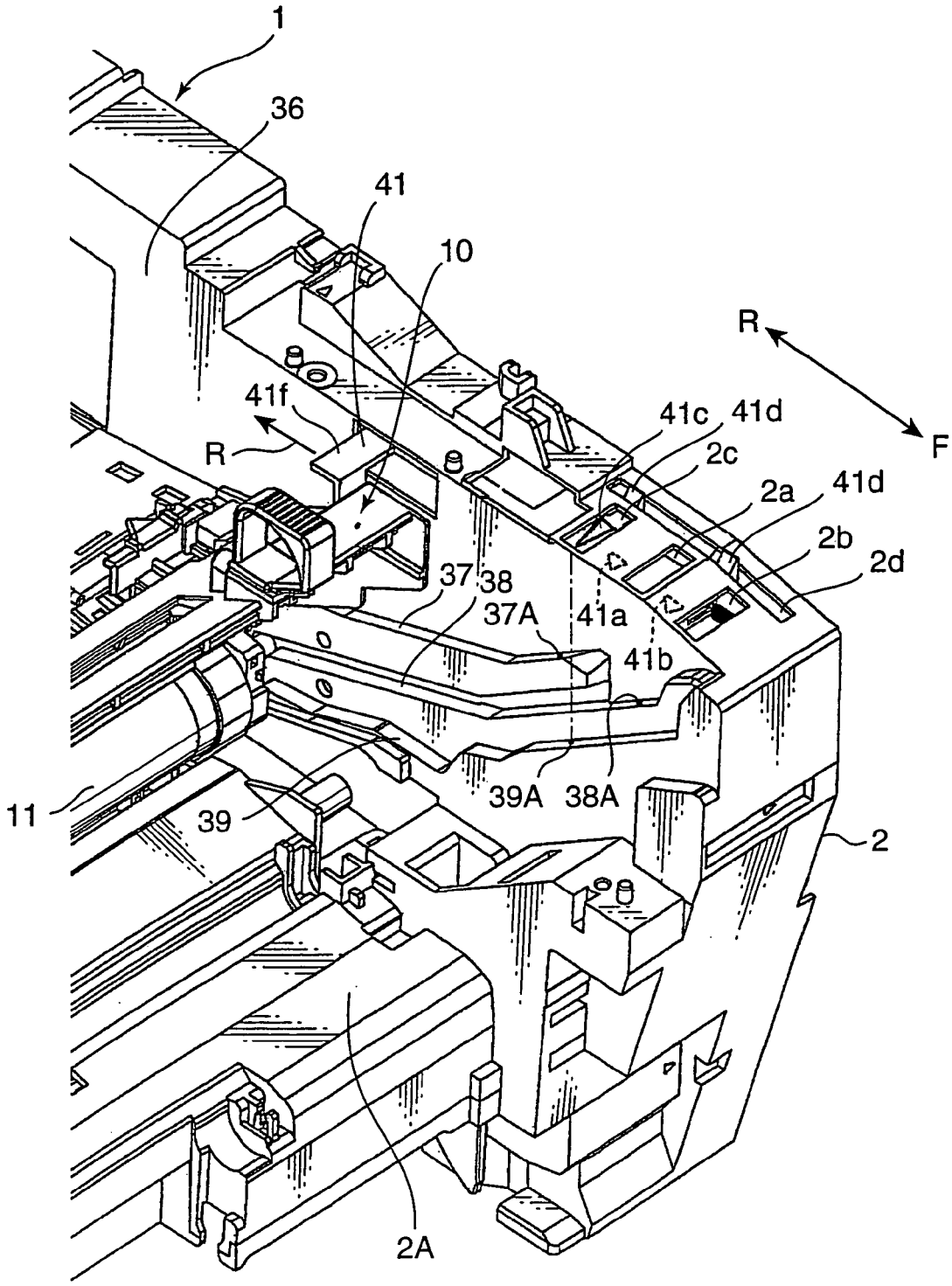
FIG. 5 is a perspective view showing a relevant part of the main body in a state after a drum unit is mounted.
Figure 10:
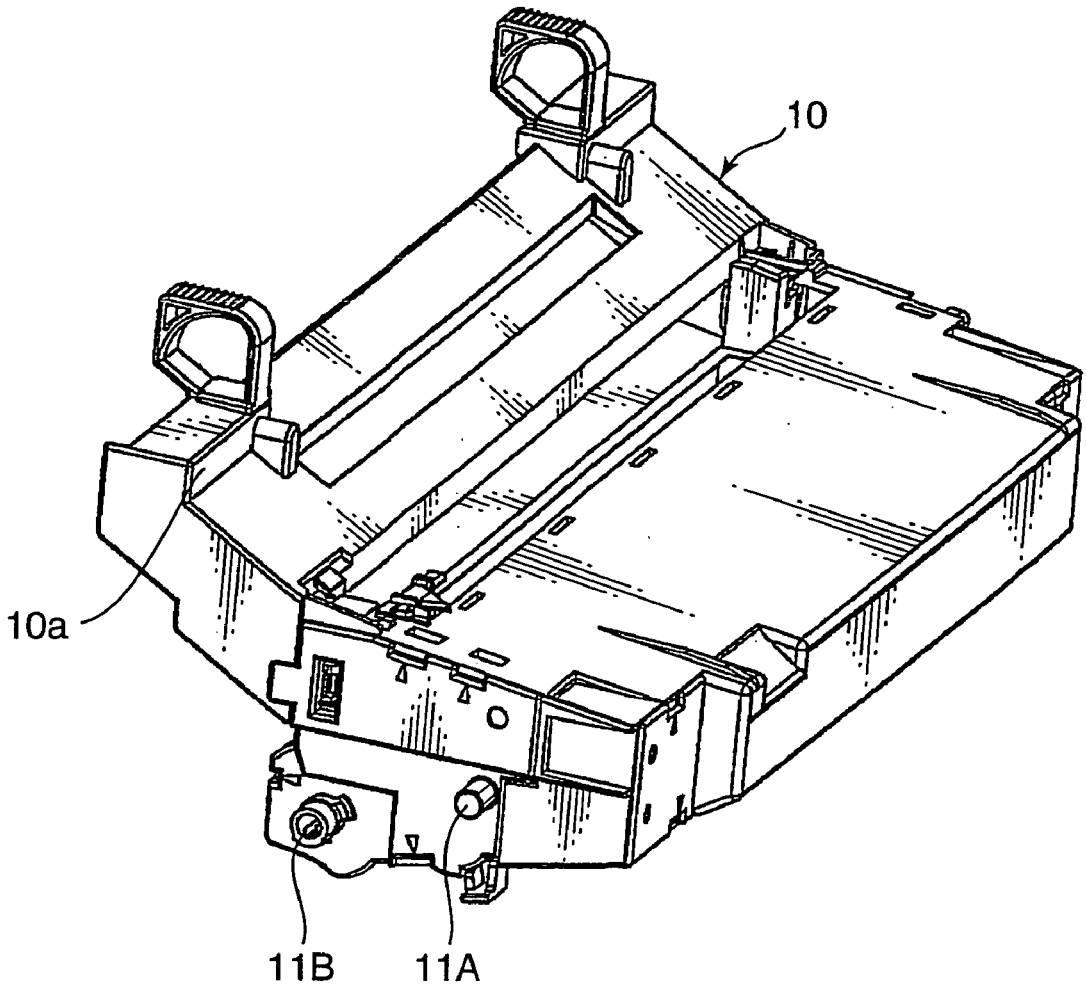
FIG. 10 is a perspective view showing the drum unit.

As shown in FIGS. 3 to 5, upper and lower guiding ways (guiding portions) 37, 38 are formed on the opposite inner walls of frames 36 located on the both sides of the chamber 2A. The drum shaft 11A (guided portion) and a guide shaft 11B (guided portion, refer to FIG. 10) of the photoconductive drum 11 are engaged with the guiding ways (guiding portions) 37, 38 respectively at initial portions 37A, 38A so that the drum unit 10 is guided to a mounting position.

As shown in FIG. 3, a position setting portion 38*a* which defines a mounting position of the drum unit 10 is formed at the end portion with respect to an inserting direction of the lower guiding way 38. When the drum unit 10 is set at the mounting position, a driven gear (unillustrated) mounted on the drum shaft 11A of the photoconductive drum 11 comes to engage with a driving gear (unillustrated) which is provided in the main body 2. Consequently, the photoconductive drum 11 is enabled to rotate.

FIG. 2 is a perspective view showing a state where the developing unit 20 is inserted into the main body 2 while the drum unit 10 is mounted beforehand. As shown in FIG. 1, the developing unit 20 includes the developing sleeve 22 at a lower portion facing the photoconductive drum 11. When the developing unit 20 is inserted into the main body 2, the developing sleeve 22 faces the photoconductive drum 11. There is a predetermined developing gap between the developing sleeve 22 and the photoconductive drum 11. The developing sleeve 22 is adapted to execute a developing process by supplying toner particles to an electrostatic latent image formed on the photoconductive drum 11.

The developing unit 20 includes in a portion opposite to the developing sleeve 22 a toner storing portion 21 (refer to FIG. 2) which stores toner particles including magnetic substances.

On each of the opposite sides of the developing unit, an anterior supporting portion (guided portion) 24A and a posterior supporting portion (guided portion) 24B are formed. The anterior supporting portion 24A is arc-shaped and protrudes in a lateral direction. The posterior supporting portion 24B is round-shaped and protrudes in a lateral direction.

A guiding way 39 which is almost parallel to the guiding ways (guiding portions) 37, 38 is formed in the frame 36 located on each of the opposite side walls of the chamber 2A. The guiding way 39 has steps. The anterior supporting portion 24A and the posterior supporting portion 24B are engaged with the guiding way 39 so as to guide the drum unit 10 to a mounting position.

In the state where the developing unit 20 is mounted in the main body 2, the developing unit 20 is pressed onto the drum unit 10 by a pressing means (unillustrated).

Since the guiding way 39 is provided more laterally centerward than the guiding ways 37, 38, a unit insertion width of the guiding ways 37, 38 is greater than that of the guiding way 39. Therefore, when the drum shaft 11A and the guiding shaft 11B of the drum unit 10 are engaged respectively with the guiding ways 37, 38, the drum shaft 11A and the guiding shaft 11B cannot be engaged with the guiding way 39. On the other hand, since the unit insertion width of the guiding ways 37, 38 is greater, the supporting portions 24A, 24B of the developing unit 20 cannot be engaged with the guiding ways 37, 38 when the supporting portions 24A, 24B are engaged respectively with the guiding way 39. Thus, misengagement can be prevented in advance.

As described above, the drum shaft 11A and the guiding shaft 11B of the photoconductive drum 11 are engaged with the guiding ways 37, 38 of the frame 36 at the initial portions 37A, 38A so as to guide the drum unit 10. to the mounting position. Further, the anterior supporting portion 24A and the posterior supporting portion 24B are engaged with the guiding way 39 of the frame 36 at the initial portion 39A so as to guide the developing unit 20 to the mounting position.

In the case where the drum shaft 11A and the guiding shaft 11B of the drum unit 10 are engaged with the respective guiding ways 37, 38 in the chamber 2A for doing maintenance on the drum unit 10, it is difficult to distinguish the respective initial portions 37A, 38A of the guiding ways 37, 38. Further, in the case where the supporting portions 24A, 24B of the developing unit 20 are engaged with the guiding way 39 in the chamber 2A for doing maintenance on the developing unit 10, it is also difficult to distinguish the initial position 39A of the guiding way 39. Accordingly, operability for insertion of the respective units 10, 20 is not good. Further, it is preferable that insertion of the units 10, 20 in wrong order can be prevented.

As shown in FIGS. 4 and 5, an indicating section is formed in a top surface of a right side end of the main body near the initial portions 37A, 38A, and 39A of the respective guiding ways 37, 38, 39. The indicating section includes first indicators 41*a*, 41*b* and a second indicator 41*c*. Each indicator has a shape of triangular arrow. Further, the indicating section includes first display windows 2*a*, 2*b* and a second display window 2*c*. The first display windows 2*a*, 2*b* are adapted to display the first indicators 41*a*, 41*b*. The second display window 2*c* is adapted to display the second indicator 41*c*. The indicators and the display windows are formed in F-R directions in the indicating section.

As shown in FIG. 4, a tip of the arrow of the first indicator 41*a* displayed at the first display window 2*a* indicates an initial position of the insertion path corresponding to the initial portion 37A of the guiding way 37, and a tip of the arrow of the first indicator 41*b* displayed at the first display window 2*b* indicates an initial position of the insertion path corresponding to the initial portion 38A of the guiding way 38. As shown in FIG. 5, a tip of the arrow of the second indicator 41*c* displayed at the second display window 2*c* indicates an initial position of the insertion path corresponding to the initial portion 39A of the guiding way 39. Further, as shown in FIG. 4, before the drum unit 10 is mounted, the first indicators 41*a*, 41*b* are displayed and the second indicator 41*c* is hided. Furthermore, as shown in FIG. 5, after the drum unit 10 is mounted, the second indicator 41*c* is displayed and the first indicators 41*a*, 41*b* are hided. The structure for switching over the displays of the first and second indicators 41*a*, 41*b*, and 41*c* is described hereinafter.

Figure 6:
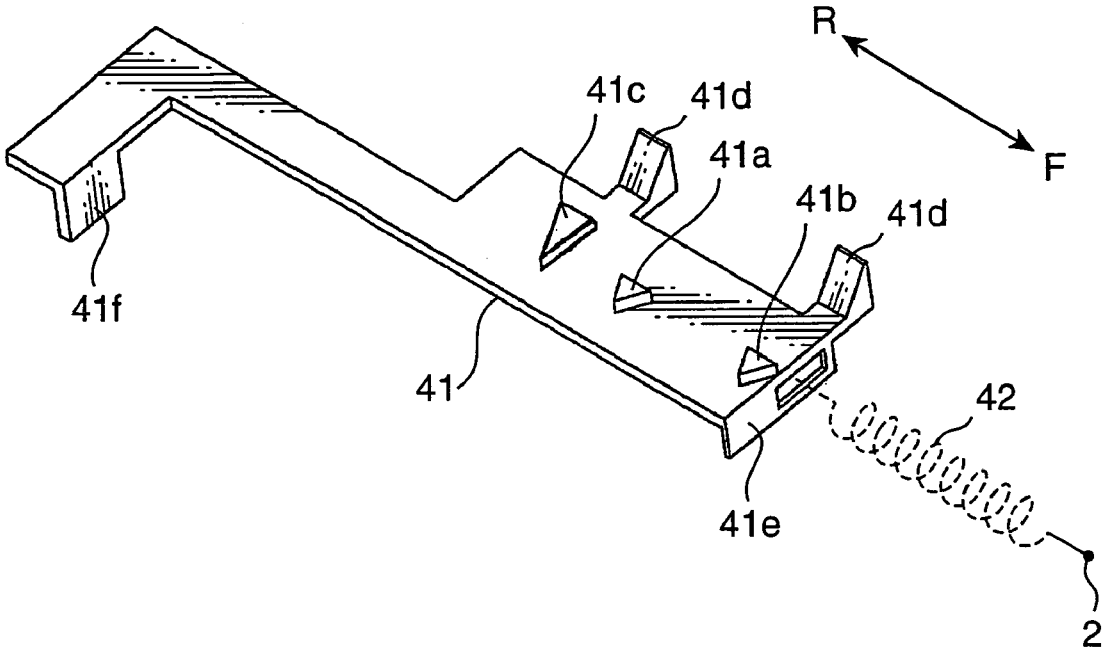
FIG. 6 is a perspective view showing an indicating member.

As shown in FIG. 6, a plate-like indicating member 41 is provided in the indicating section. The first indicators 41*a*, 41*b* and the second indicator 41*c* are formed on an upper surface of the indicating member 41. As shown in FIG. 4, the first indicators 41*a*, 41*b* are formed on the indicating member 41 in such positions that they are displayed at the first display windows 2*a*, 2*b* while the second indicator 41*c* is hided at a middle portion between the display windows 2*c*, 2*a*. As shown in FIG. 5, the second indicator 41*c* is formed on the indicating member 41 in such a position that it is displayed at the display window 2*c* while the first indicator 41*a* is hided at the middle portion between the display windows 2*c* and 2*a*, and the first indicator 41*b* is hided at the middle portions between the display windows 2*a*, 2*b*.

The indicating section includes an elongate hole 2*d* formed along the respective display windows 2*a*, 2*b*, 2*c*. A pair of projections 41*d* is formed on the indicating member 41. The projections 41*d* are inserted into the elongate hole 2*d* from bottom and are locked so that the indicating member 41 is guided to slide in the elongate hole 2*d* in F-R directions.

Figure 7:
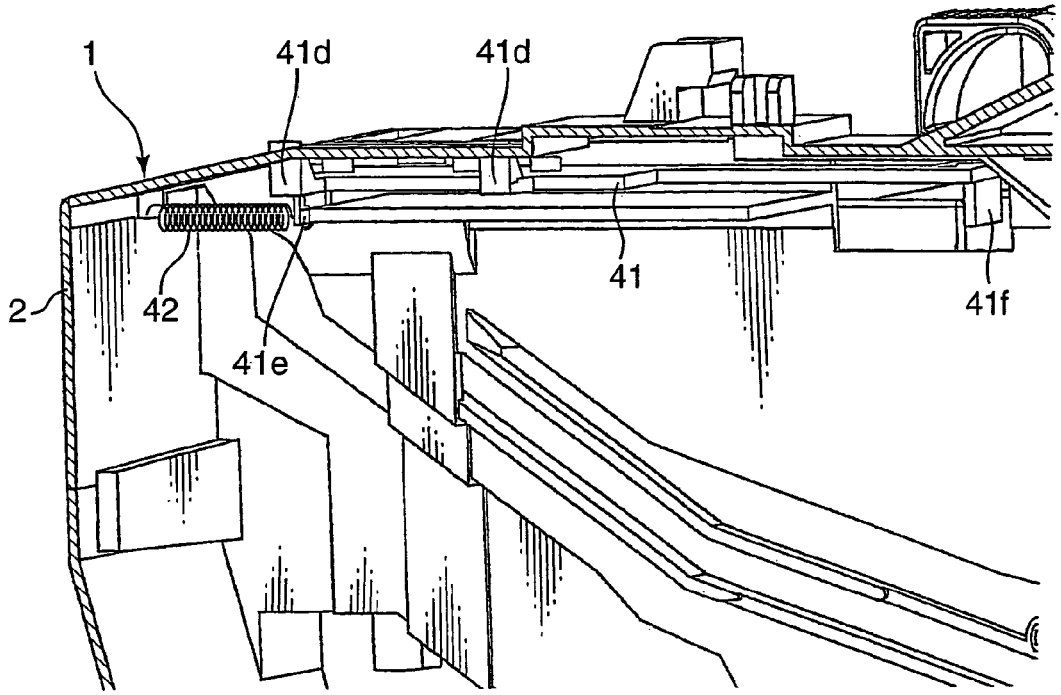
FIG. 7 is a side perspective view showing the indicating member.

At the posterior end portion of the indicating member 41, a spring mounting portion 41*e* is formed. A coil spring 42 is provided between the spring mounting portion 41*e* and the main body 2 (refer to FIG. 7). In a state where the coil spring 42 urges the indicating member 41 in the direction F and the indicating member 41 is stopped by a stopper (unillustrated), the first indicators 41*a*, 41*b* are displayed at the display windows 2*a*, 2*b* while the second indicator 41*c* is not displayed at (or is hided from) the display window 2*c*.

The indicating member 41 has at an anterior end portion a contact portion 41*f*. The contact portion 41*f* projects into the chamber 2A and is operable to come in contact with the drum unit 10. If the drum unit 10 inserted comes in contact with the contact portion 41*f*, the indicating member 41 moves in a backward direction R through the contact portion 41*f* while it resists the urging force exerted by the coil spring 42. Consequently, the second indicator 41*c* is displayed at the second display window 2*c*, and the first indicators 41*a*, 41*b* are not displayed at (or are hided from) the display windows 2*a*, 2*b*.

Figure 8:
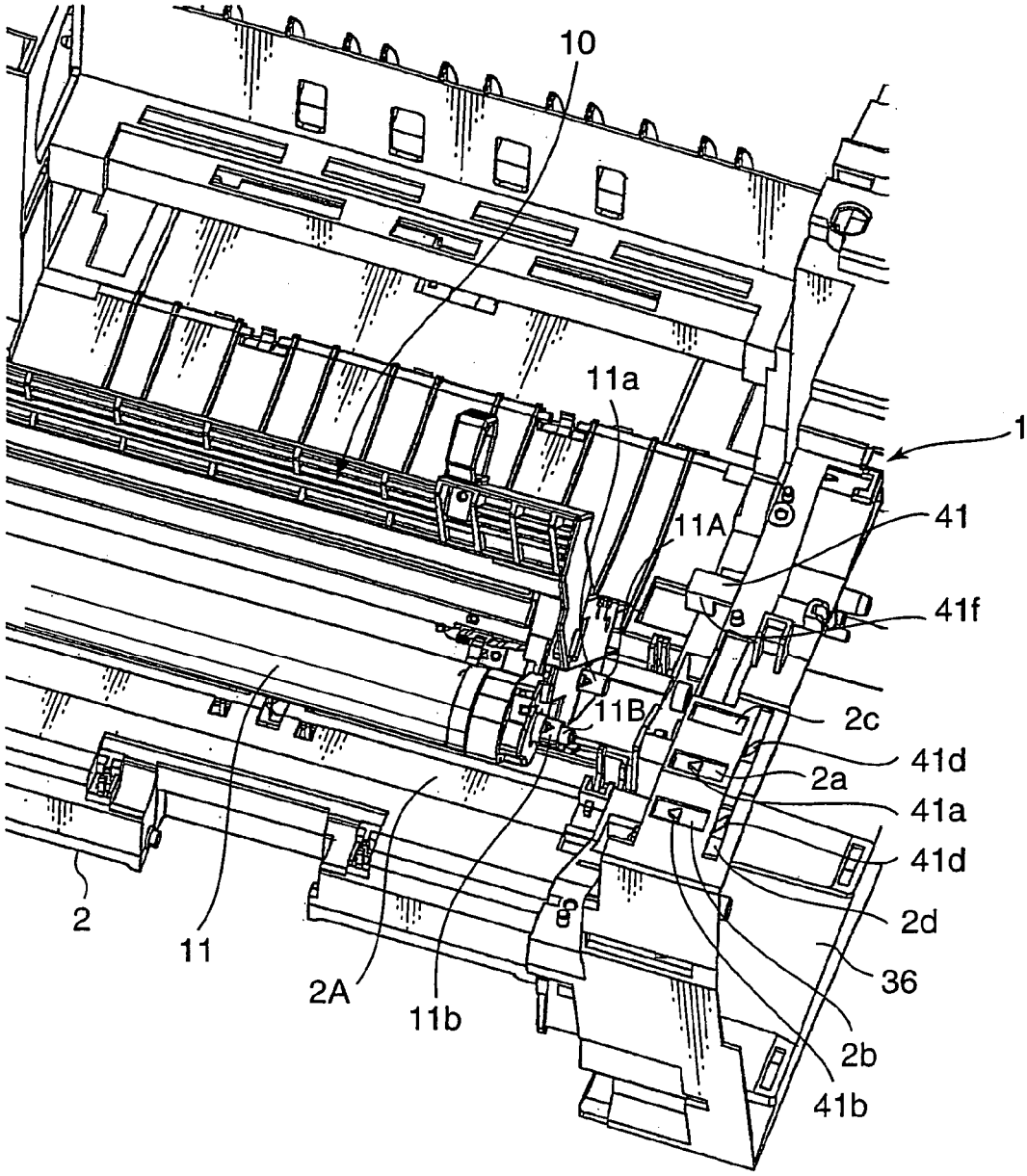
FIG. 8 is a perspective view showing a relevant part of the main body in a state after a drum unit is mounted.

As shown in FIG. 8, the drum shaft 11A and the guiding shaft 11B of the drum unit 10 are provided with marks 11*a* and 11*b* respectively. The marks 11*a* and 11*b* correspond respectively to the first indicator 41*a*, 41*b*. Each of the marks 11*a*, 11*b* has a shape of triangular arrow. Further, each of the supporting portions 24A, 24B of the developing unit 20 may also be provided with a mark having a shape of triangular arrow corresponding to the second indicator 41*c*.

According to the construction of the image forming apparatus 1 as described above, in the case where the chamber cover 35A is opened and the drum unit 10 is inserted in advance into the chamber, the indicating member 41 is in the state being urged to move in the direction F by the coil spring 42 and come in contact with the stopper to be stopped so that the first indicators 41*a* and 41*b* are displayed at the first display windows 2*a*, 2*b* while the second indicator 41*c* is not displayed at the display window 2*c*. Consequently, the initial portions 37A, 38A of the guiding way 37, 38 which are to be engaged with the drum shaft 11A and the guiding shaft 11B of the drum unit 10, namely, initial positions of the insertion path, can be visually confirmed. Accordingly, the operability of insertion of the drum unit 10 is improved since the drum shaft 11A and the guiding shaft 11B of the drum unit 10 can be smoothly engaged with the initial portions 37A, 38A of the guiding ways 37, 38 of the main body 2.

Since the marks 11*a* and 11*b* which correspond respectively to the first indicator 41*a*, 41*b* are formed on the drum shaft 11A and the guiding shaft 11B of the drum unit 10 respectively, the drum shaft 11A and the guiding shaft 11B of the drum unit 10 can be smoothly engaged with the initial portions 37A, 38A of the respective guiding ways 37, 38 just bymating the marks 11*a* and 11*b* to the first indicators 41*a*, 41*b*.

On inserting the drum unit 10 to the mounting position, a contact portion 10*a* of the drum unit 10 comes into contact with the contact portion 41*f* of the indicating member 41 so that the indicating member 41 resists the urging force of the coil spring 42 and is moved backward in the direction R. Accordingly, the second indicator 41*c* is displayed at the display window 2*c* while the indicators 41*a* and 41*b* are not displayed at the display windows 2*a*, 2*b*.

Figure 9:
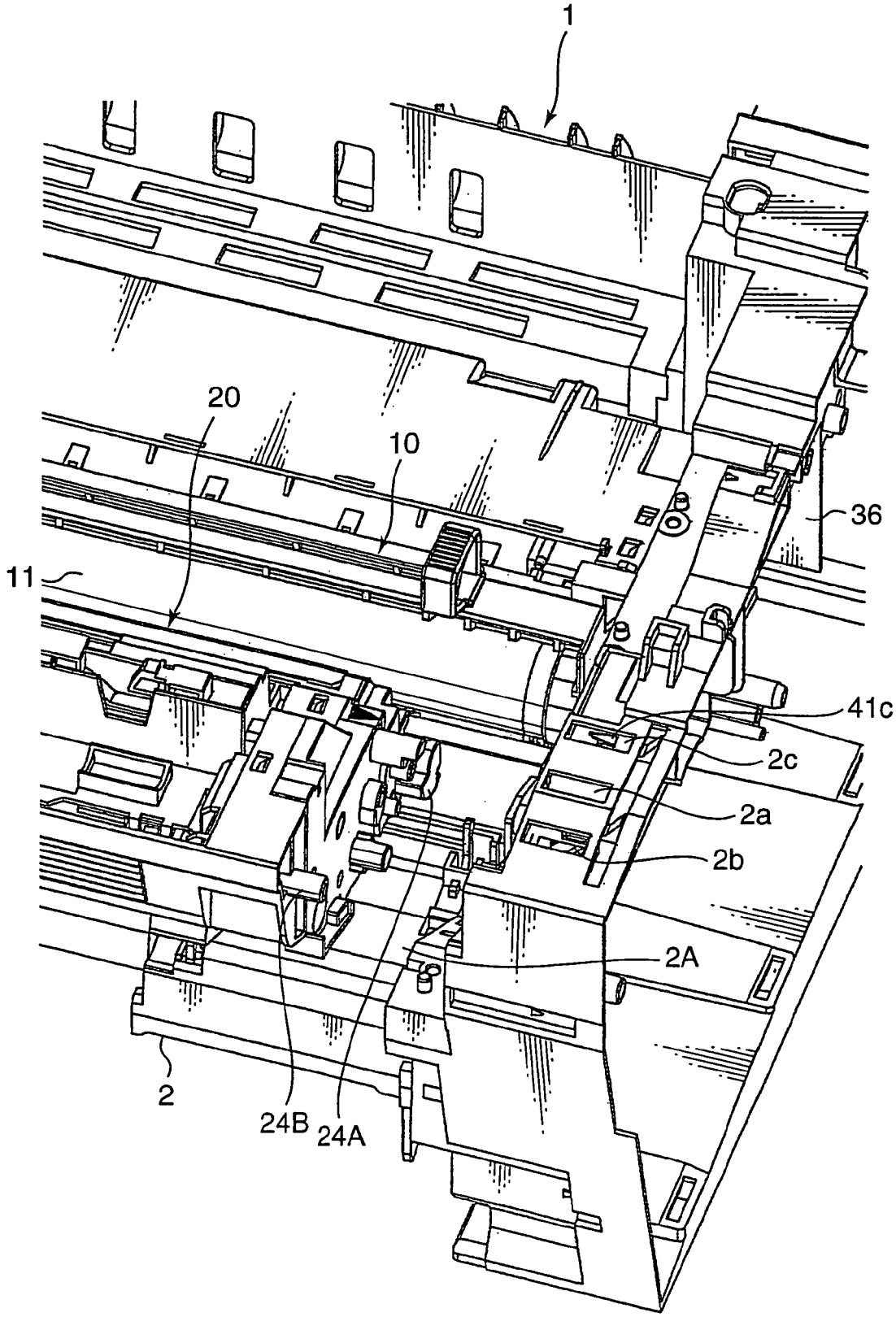
FIG. 9 is a perspective view showing a relevant part of the main body in a state right before a developing unit is mounted.

Then, as shown in FIG. 9, in the case where the developing unit 20 is inserted, the initial portion 39A of the guiding way 39 for the respective supporting portions 24A, 24B of the developing unit 20, namely the initial position of the insertion path, can be visually confirmed by the second indicator 41*c*. Accordingly, the operability of the insertion of the developing unit 20 is improved since the respective supporting portions 24A, 24B of the developing unit 20 can be smoothly engaged to the initial portion 39A of the guiding way 30 of the main body.

Further, the indicating section may be so constructed that the indicating member 41 moves with the mounting and dismounting operations of the drum unit 10. According to such construction, before the drum unit 10 is mounted, the first indicators 41*a*, 41*b* are displayed while the second indicator 41*c* is hided so that the drum shaft 11A and the guiding shaft 11B of the drum unit 10 can be engaged with the initial portions 37A, 38B of the guiding ways 37, 38 of the main body 2 by watching the first indicators 41*a*, 41*b* only. Further, after the drum unit 10 is mounted, the second indicator 41*c* is displayed while the first indicators 41*a*, 41*b* are hided so that the respective supporting portions 24A, 24B of the developing unit 20 can be engaged with the initial portion 39A of the guiding way 39 of the main body 2 by watching the second indicator 41*c* only. Consequently, misunderstanding of the insertion order of the drum unit 10 and the developing unit 20 can be prevented more assuredly.

According to the construction described above, the display windows 2*a*, 2*b*, 2*c* and such are provided in the indicating section formed in the top surface of the right side end of the main body 2. If the indicating section is provided also in the left side end of the main body 2, namely in both sides of the main body 2, a possibility that the drum unit 10 and the developing unit 20 are engaged with the guiding ways 37, 38, 39 in the state where the respective units are tilted.

This application is based on patent application No. 2005-121176 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a main body having a chamber;

a plurality of units being separable from one another and fully detachable from the main body, the units having operative functions different from one another, respectively, each unit having a guided portion, and being dismountably mounted in the chamber of the main body independently of one another and in a specified insertion order;

a plurality of pairs of guiding members defining respective insertion paths for the plurality of units, each pair of guiding members being formed on opposite walls of the chamber; and a plurality of indicators provided in the main body, the indicators being changeable for indicating initial positions of the respective insertion paths, in the specified insertion order.

2. An image forming apparatus according to claim 1, wherein each of the plurality of units is provided near the guided portion with a mark which corresponds to each of the plurality of indicators.

3. An image forming apparatus according to claim 1, wherein one of the plurality of pairs of guiding members defines a narrower insertion path than another of the plurality of pairs of guiding members.

4. An image forming apparatus according to claim 1, wherein the plurality of units includes a drum unit.

5. An image forming apparatus according to claim 1, wherein the plurality of operative units includes a developing unit.

6. An image forming apparatus according to claim 1, wherein the chamber has an insertion opening in top and front walls of the main body.

7. An image forming apparatus comprising:

a main body having a chamber;

a plurality of units having operative functions different from one another, respectively, each unit having a guided portion, and being dismountably mounted in the chamber of the main body;

a plurality of pairs of guiding members defining respective insertion paths for the plurality of units, each pair of guiding members being formed on the opposite walls of the chamber; and a plurality of indicators provided in the main body for indicating initial positions of the insertion paths, respectively;

an indicating member provided in the main body and bearing plurality of indicators for indicating initial positions of the insertion paths, respectively, the indicating member being movable in conjunction with an insertion of each of the plurality of units to display only one of the plurality of indicators when no units are inserted in the chamber, and display only another of the plurality of indicators when one of the plurality of units is inserted in the chamber.

8. An image forming apparatus according to claim 7, further comprising a display section including a first display window for displaying a first indicator of the plurality of indicators and a second display window for displaying a second indicator of the plurality of indicators, the first and second display windows being formed in a top surface of a side end of the main body, and the first indicator being displayed at the first display window and the second indicator being hidden at a middle portion between the first display window and the second display window before a particular one of the plurality of units is mounted, and the second indicator being displayed at the second display window and the first indicator being hidden at the middle portion after the particular one is mounted.

9. An image forming apparatus according to claim 8, further comprising another display section including a first display window and a second display window formed in a top surface of a second side end of the main body of the apparatus.

10. An image forming apparatus according to claim 8, wherein the display section further includes an elongated hole formed along the first and second display windows, and a projection formed on the indicating member and slidable in the elongated hole with the movement of the indicating member.

11. An image forming apparatus according to claim 8, wherein the indicating member includes a contact portion projecting into the chamber and operable to come into contact with a particular one of the plurality of units being inserted to thereby move the indicating member.

12. An image forming apparatus comprising:

a main body having a chamber;

a plurality of units having operative functions different from one another, respectively, each unit having a guided portion, and being independently mountable in the chamber of the main body in a specified insertion order and fully detachable from the main body;

a plurality of pairs of guiding members defining respective insertion paths for the plurality of units, each pair of guiding members being formed on the opposite walls of the chamber; and a plurality of indicators provided in the main body, the indicators being changeable for sequentially indicating initial positions of the insertion paths, in the specified insertion order.

13. An image forming apparatus according to claim 12, wherein each of the plurality of units is provided near the guided portion with a mark which corresponds to each of the plurality of indicators.

14. An image forming apparatus according to claim 12, wherein one of the plurality of pairs of guiding members defines a narrower insertion path than another of the plurality of pairs of guiding members.

15. An image forming apparatus according to claim 12, further comprising a feeding tray disposed in the main body and being configured for storing sheets of a recording medium and a discharging tray disposed externally of the main body for storing sheets of the recording medium that have had an image fixed thereon.

16. An image forming apparatus according to claim 12, further comprising a display section including a first display window for displaying a first indicator of the plurality of indicators and a second display window for displaying a second indicator of the plurality of indicators, the first and second display windows being formed in a top surface of a side end of the main body, and the first indicator being displayed at the first display window and the second indicator being hidden at a middle portion between the first display window and the second display window before a particular one of the plurality of units is mounted, and the second indicator being displayed at the second display window and the first indicator being hidden at the middle portion after the particular one is mounted.

17. An image forming apparatus according to claim 16, wherein the indicating member includes a contact portion projecting into the chamber and operable to come into contact with a particular one of the plurality of units being inserted to thereby move the indicating member.

18. An image forming apparatus comprising:

a main body having a chamber;

a plurality of units having operative functions different from one another, respectively, each unit having a guided portion, each unit further being dismountably mounted in the chamber of the main body so that each of the units is fully detachable from the main body when dismounted;

a plurality of pairs of guiding members defining respective insertion paths for the plurality of units, each pair of guiding members being formed on opposite walls of the chamber, one of the plurality of pairs of guiding members defining a narrower insertion path on each of the opposite side walls of the chamber than another of the plurality of pairs of guiding members; and a plurality of indicators provided in the main body for indicating initial positions of the insertion paths, respectively, wherein the indicators are movable for sequentially indicating the initial positions in a specified order.

* * * * *